United States Patent [19]

Stern

[11] 4,056,213

[45] Nov. 1, 1977

[54] PRESSURIZED DISPENSER FOR AQUEOUS EMULSION PAINTS

[75] Inventor: David Stern, Roslyn, N.Y.

[73] Assignee: Martin Paint and Chemical Corporation, Jamaica, N.Y.

[21] Appl. No.: 540,812

[22] Filed: Jan. 14, 1975

Related U.S. Application Data

[63] Continuation-in-part of Ser. No. 168,916, Aug. 4, 1971, abandoned.

[51] Int. Cl.[2] ..... B65D 35/28

[52] U.S. Cl. ..... 222/95; 222/402.12; 260/29.6 MM

[58] Field of Search ..... 260/29.6 MM, 29.6 R; 222/386.5, 95

[56] References Cited

U.S. PATENT DOCUMENTS

| | | | |
|---|---|---|---|
| 2,953,284 | 9/1960 | Prussin et al. | 222/394 |
| 3,370,024 | 2/1968 | Grasko et al. | 260/3.5 |
| 3,488,308 | 1/1970 | Colbert et al. | 260/23 |

OTHER PUBLICATIONS

Paint Industry Processing & Materials Manual, (1966), RCH Publications, New Kingston, Pa., p. 50.

*Primary Examiner*—Lucille M. Phynes

*Attorney, Agent, or Firm*—Ostrolenk, Faber, Gerb & Soffen

[57] ABSTRACT

The invention relates to an improved pressurized dispenser for aqueous emulsion paints whose vehicle consists of a major proportion of water and a minor proportion of an acrylic polymer or polyvinyl acetate-acrylic copolymer, the emulsion being discharged as a fine spray but without foaming and without clogging of the nozzle orifice by dried paint even after repeated fractional discharges. The paint is contained in a collapsible piston within the pressurized container and the stream of paint discharging upon opening of the valve of the container is broken up by a mechanical breaker before being discharged through the nozzle in the form of a fine spray devoid of propellant, the latter being contained under pressure between the piston and the wall of the container. Means are provided in the form of a cap for the nozzle so constructed so as to reduce or substantially eliminate the space about the nozzle after use of portions of the contents of the package to prevent drying out of any paint adhering to the nozzle and thereby clogging the nozzle.

12 Claims, 7 Drawing Figures

PRESSURIZED DISPENSER FOR AQUEOUS EMULSION PAINTS

This application is a continuation-in part of my copending application Ser. No. 168,916, filed Aug. 4, 1971 and now abandoned.

The present invention, relates to a pressurized package for an aqueous acrylic emulsion paint for discharge in the form of a spray, and to an improved container for effecting discharge of the emulsion without admixture with the propellant.

Latex paints have not been successfully incorporated in aerosol or pressurized cans for commercial sale for discharge in the form of a spray devoid of propellant and substantially free from foaming, which makes uniform application difficult or even practically impossible, because it has been found that the paint employed could not be atomized at the permissible pressures without entrained propellant and/or that after each use the paint would dry or congeal in and about the nozzle and make further use of the dispenser difficult or even impossible.

I have found that the difficulty encountered by reason of foaming and of the clogging of the nozzle of the pressurized can containing the latex paint can be overcome by the use of a special formulation for the paint and by the use of a specially constructed piston type of pressurized can. In this type of can the propellant does not mix with the discharged paint but acts instead against a bellows-like piston which keeps the propellant separate from the latex paint. Furthermore, and in accordance with the invention, the nozzle is so shaped as to receive a snugly fitting cap which greatly reduces or practically eliminates an air-space, which may be termed an evaporation space, about the discharge orifice of the nozzle, so that evaporation is minimal or does not occur at all, and any liquid left in the nozzle or adhering about its orifice remains in liquid form and does not dry out to cause a deposit of gummy or solid material. Also, by the provision of an break-up attachment at or in advance of the nozzle orifice, conversion of the paint into a spray is accomplished without the aid of entrained or dissolved propellant. These features, namely, the special paint formulation, the use of a piston type pressurized dispenser and the application of a cap to the discharge orifice of the nozzle which discourages evaporation of the paint, and especially together with the break-up device, have made it possible to discharge a latex paint in the form of a spray through the narrow nozzle orifice of a pressurized can while preventing clogging of the nozzle by dried paint.

In accordance with the invention, the space about the nozzle and within the cap when the pressurized dispenser is not in use is made as small as possible, so that a minimum of the water will evaporate into such space from the paint adhering to the nozzle after use of the dispenser. This space, the "evaporation space", is reduced to a minimum by suitable construction of a cap which is fitted over the nozzle after use of the dispenser and can be made to enclose an evaporation space of very small volume. Preferably, the cap is provided with a conical projection which fits into the nozzle orifice, and thereby reduces the evaporation space practically to zero.

The invention will be further described with the aid of the accompanying drawing forming part of this specification and in which FIG. 1 is an external perspective view of a pressurized container or can constructed in accordance with the invention;

Figure 2:
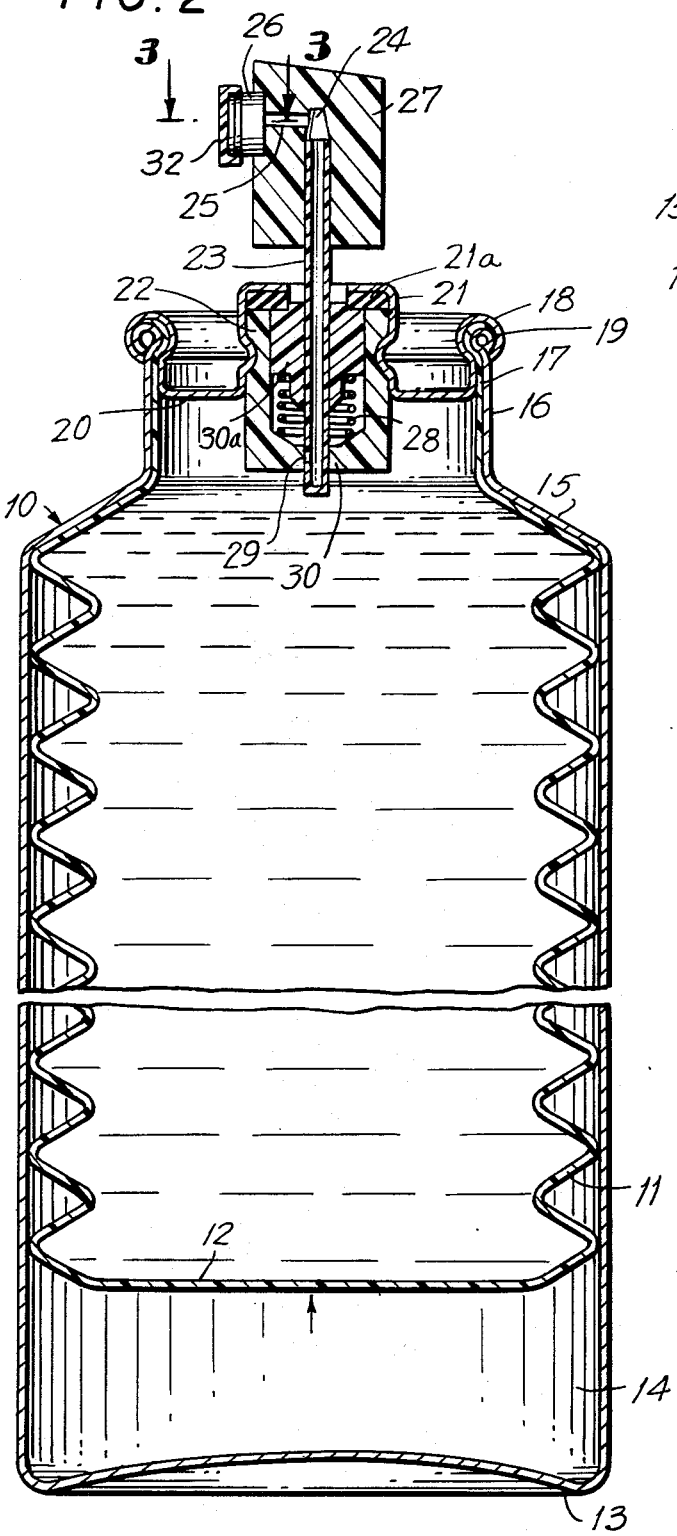
FIG. 2 is an enlarged central vertical section along the line 2—2 of FIG. 1.
Figure 1:
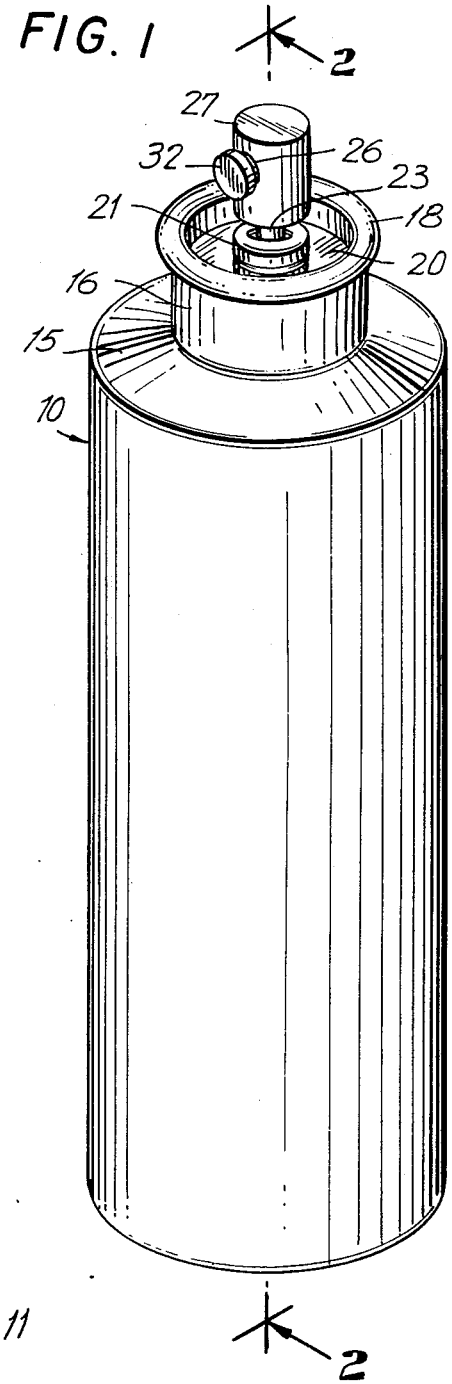

Referring to the drawing, there is shown at 10 a pressurized can or container of the type provided interiorly thereof with a collapsible bellows or piston 11 made of any suitable pliable material which is non-reactive the paint composition contained therein or the propellant employed as hereinafter described, polyvinyl chloride, polyethylene, and natural and synthetic rubbers being examples of such suitable materials.

The piston 11 has a relatively flat bottom wall 12 and between such wall and the bottom 13 of the can there is provided a space 14 into which has been charged a propellant having a boiling point such that at approximately room temperature (70° F.) there is formed a vaporous or gaseous atmosphere of about 55 lbs./sq. in. which acts against the bottom 12 of the piston to place the contents of the piston under pressure.

The upper portion of the can is inclined as indicated at 15 and terminates in a cylindrical portion 16 whose free end is crimped, along with the upper end 17 of the piston, to provide a bead 18 in known manner. About this bead there is bent the upper end of an annular cap 20 of U-shaped cross-section whose inner wall 21 is sealed against a relatively soft, flexible washer **21*a* resting on and sealing the upper end of a fixed U-shaped plastic valve body 22**.

Fixed to the valve body 22 is a tube 23, closed at its bottom end and leading into a chamber 24 within the depressible button or finger-piece 27, the chamber being connected by a duct 25 with a nozzle head 26, which is force fitted into a counterbore in the button. The button is depressible against the resistance of a spring 28 disposed between the bottom of the valve body and a guide block **30*a* slidable within the valve body and fixed to the tube 23. Upon removal of the cap 32, and depression of the button a lateral opening 29 in the tube 23 is lowered out of registry with the bottom portion 30 of the valve body 22, and thus into communication with the upper part of the piston into which the paint has been raised upon rise of the bottom of the piston. The paint contained within the piston is discharged through tube 23 and nozzle orifice 31** (FIG. 3) into the atmosphere. The discharge continues so long as the button is depressed and until the piston is collapsed to the maximum extent.

The construction of the valve which operates to allow paint under pressure to be discharged through tube 23 can be of any known type and the construction shown in the drawing is presented only by way of example.

Figure 3:
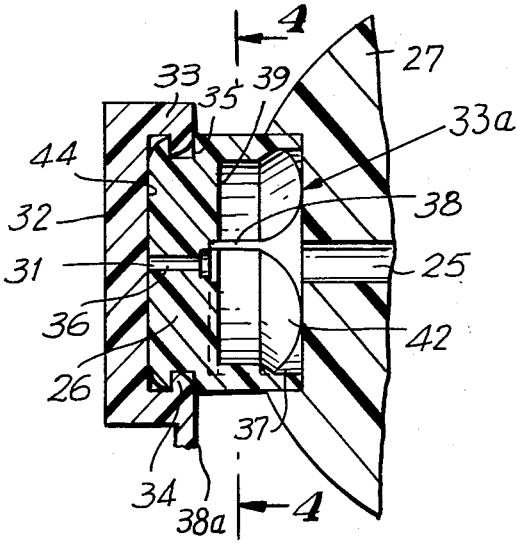
FIG. 3 is an enlarged horizontal section through the nozzle of the pressurized can and is taken along the line 3—3 of FIG. 2 looking in the direction of the arrows.

In accordance with the invention, the cap 32 is so constructed, as shown for example in FIG. 3, that it closely embraces the nozzle head and closes the nozzle orifice. The cap is made of resilient plastic material which is not reactive toward the paint composition and may be formed, as illustrated, of a flat portion having an annular extension 33 terminating in an inwardly extending flange 34 which snaps into an annular recess 35 in the nozzle head 26, which itself may be formed of rigid plastic, and may have a removal tab 38*a*.

Figure 4:
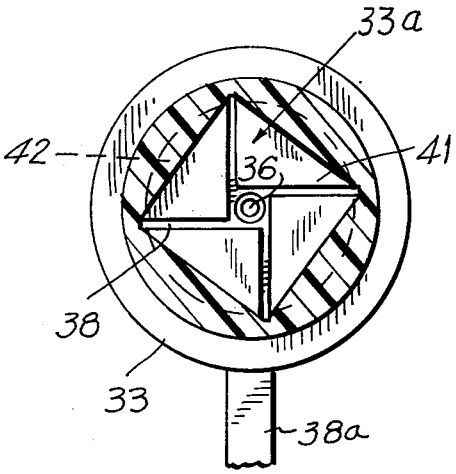
FIG. 4 is a vertical section along the line 4—4 of FIG. 3.

In a further development of the invention I provide a mechanical breaker or baffle 33*a* which operates to effect a pre-atomization of the stream or jet of paint by breaking up the stream before it enters the nozzle passageway 36, so that the broken-up stream emerges from the orifice 31 as a spray. As shown in FIGS. 3 and 4, the stream of paint delivered by the duct 25 passes through the rear counterbore 37 of the nozzle body and becomes distributed into a number of narrow approximately radial grooves 38 by which the stream is broken up and is then directed into the nozzle passageway 36.

The breaker is formed in the front wall 39 of the nozzle head and is in the form of a preferably square body 40 which may be molded integrally with or secured to the front end wall of the nozzle. The body is traversed by the grooves 38, preferably four, which communicate with the passageway 36 and divide the said body into four more or less triangular sections 41 from whose edges adjacent to the outer wall of the nozzle head there rise flat walls which are connected by arcuate portions 42 with the wall of the counterbore. These grooves or channels effect both thorough mixing of the jet of paint and also contribute to the break-up of the jet as it enters the nozzle passageway 36.

Figure 5:
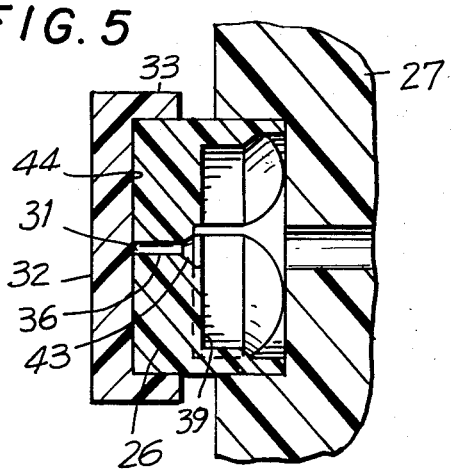
FIGS. 5, 6 and 7 illustrate further embodiments of the invention.
Figure 6:
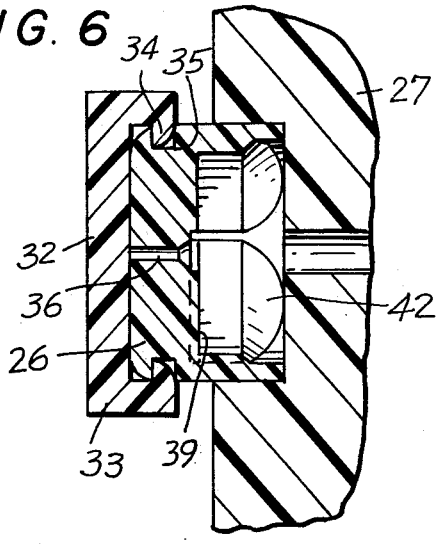

As shown in FIGS. 3 and 4 the duct 25 is of larger diameter than the nozzle passageway 36, and there is an abrupt reduction in the diameter of the paint stream as it enters passageway 36. In the construction shown in FIG. 5 the transition from the passageway leading from the tube 23 into the nozzle passageway 36 is gradual, there being a conical transition region 43 between the two passageways. There is shown also a cap which is of simple cylindrical form and fits over the nozzle head so closely that the available evaporation space is practically zero. FIG. 6 shows the nozzle arrangement of FIG. 5 associated with a cap 32 of the type shown in FIG. 3.

Figure 7:
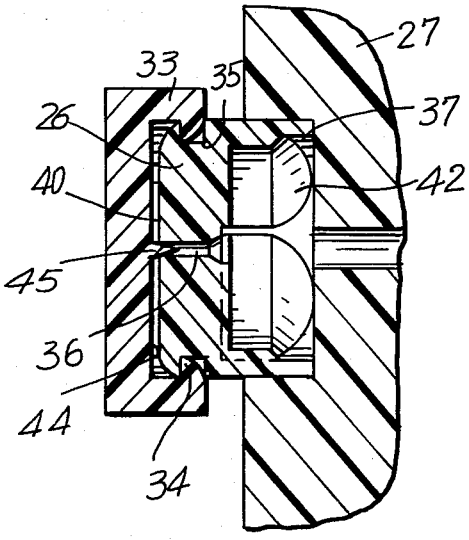

FIG. 7 shows a cap whose interior surface 44 does not abut against the outer surface of the nozzle head, but is slightly spaced therefrom. However, there is provided at the center of the cap a conical projection 45 which fits into the nozzle orifice and completely seals the same, thereby preventing evaporation of any paint remaining in the nozzle passageway 36.

The nozzle body is force-fitted into a suitable bore in the thumb-piece 27 in such manner that the counterbore is bounded at one end by the four approximately triangular portions 41 but is open at its opposite end where it communicates with the hollow stem or tube 23 of the valve.

Despite the absence of dissolved or entrained propellant, as is the case with the more common types of aerosol dispensers, I obtain a high degree of atomization of the discharged paint by the aid of the above described mechanical breaker, which may be responsible for as much as 90% of the atomization of the paint. With the mechanical breaker I employ nozzle orifice diameters ranging from about 0.016 inch to about 0.020 inch. The most suitable size of nozzle orifice will usually be determined by the viscosity or pigment content of the paint.

Any suitable propellant can be employed which places the contents of the collapsible piston under a pressure of a maximum of about 55 lbs./sq. in. at 70° F. A suitable mixture is "Freon 12" (70%) and "Freon 11" (30%). A mixture of "Genetron 11" and "Genetron 12" (Allied Chemical Co.) can also be employed.

The pressure dispensed paint can yield a flat, semi-gloss, or high gloss surface and the paint can be clear (i.e., a varnish), and it may be in the form of a metallic paint wherein the pigment can consist entirely or in part of aluminum, gold, copper, bronze or other metallic powder. The particle size in each case will, of course, be such that the paint will readily pass through the nozzle of selected orifice diameter. In the case of the clear aqueous varnish, I prefer one having a low solids content, such as one containing about 15 to 20% of varnish resin.

The paints preferably have viscosities of about 10 to 60 sec. as measured on the No. 4 Ford cup.

The type of latex paint to be packaged in a piston type of pressurized can above described is represented by way of example by the following composition:

EXAMPLE 1

Latex Redwood Spray:

This aqueous spray is composed of the following substances in approximately the proportions indicated:

| | % By Weight | % By Weight |
|---|---|---|
| Pigment | | 6.18 |
| Composed of | | |
| 1. Synthetic Iron Oxide | 72.72 | |
| 2. Attapulgus Clay | 27.28 | |
| Vehicle | | 93.82 |
| 3. Water | 62.90 | |
| 4. Surfactant | 1.02 | |
| 5. Antifoam Agent | 0.22 | |
| 6. Ester Alcohol | 0.95 | |
| 7. Preservative | 0.11 | |
| 8. Resin | 34.80 | |

Examples of the substances listed above and their properties are as follows:

Pigment

1. Synthetic Iron Oxide: Jet milled synthetic red iron oxide
   Code #J3110
   Specific gravity 5.5
   Oil absorption 20
   Hegman dispersion index 6¼
   Density (lb./gallon) 42.90
   Permanence index Min. 9.9
2. Attapulgus clay, sold by Minerals and Chemical Division of Engelhard
   Available as "Attagel" 40 or 50 Fine
2. Attapulgus clay (continued)
   Average particle size in microns 0.14
   Free moisture as produced
   (wt. % at 220° F.) 12.0
   Lb. per gal. 19.70
   Color Light Cream Vehicle 3. Water: Tap water is satisfactory.
4. Surfactant: Igepal CTA 639 (General Aniline):
   Polyoxyethylated p-nonylphenol.
   Aromatic, colorless liquid
   Density at 25° C 1.06
   Flash point 535 - 555° F.
   Cloud point 126 - 133° F.
5. Antifoam Agent: Colloid 677
   (Colloids Inc., Newark, N. J. 07114)
   pH 5.8
   Wt./gal. at 70° F. 7.35 lbs.
   Physical state: Pale yellow liquid
6. Ester Alcohol (coalescing agent): "Texanol" (a water-immiscible 12-carbon ester-alcohol)
   (Eastman Chemical Products, Inc.)
   Specific gravity, 20°/20° C 0.945 - 0.955
   Carbonyl, as C = 0, wt. % 0.4% max.
7. Preservative: "Dowicil 100" (Dow Chemical Co.)
   Non-phenolic antimicrobial agent (1-[3-chlorallyl]-3,5,7 triaza-1-azoniaadamantane chloride).

-continued ("Dowicil 100" preservative has been registered with the United States Department of Agriculture in conformance with the Federal Insecticide and Fungicide Act #464-327.)

8. Resin: AC 490 (Rohm & Haas) 100% acrylic emulsion (46% solid acrylic resin); or
Celanese CL-222, 100% vinyl-acrylic emulsion (55% solids).

AC 490 (or Rhoplex AC-490) is an aqueous acrylic emulsion containing lower alkyl esters of acrylic acid and methacrylic acid wherein the lower alkyl group has up to four carbon atoms, a small amount of an unsaturated carboxylic acid, and a minor amount of another ethylenically unsaturated compound.

Celanese CL-222, more specifically, is a stabilized, non-ionic, high molecular weight, fine particle size polyvinylacetate-acrylic copolymer emulsion.

The viscosity range is 15 sec. to 60 sec. (measured by the No. 4 Ford cup).

For redwood finishes I prefer to employ as the surfactant, as above indicated, polyoxethylated p-nonylphenyl. For other latex aerosol paints the surfactant or wetting agent can be any known and suitable substance depending upon the desired color of the paint. The wetting agent acts to reduce the surface tension of the paint. Suitable other surfactants or wetting agents are "Tamol 731" and "Tamol 850" (Rohm & Haas), pigment dispersants for aqueous systems, and "Igepol CO 630" (General Aniline), a nonylphenoxypoly(ethylencoxy) ethanol having a hydrophylic number of 63 and a concentration of 99 plus %. For redwood finishes, General Aniline's "CTA 639" yields exceptionally good results.

In general I prefer to employ an aqueous vinyl-acrylic vehicle whose total solids content is about 30% by weight and whose viscosity is 20–25 sec. on the No. 4 Ford cup. The gloss has a value of 60–70, No. 60° on the Gardner scale. The particle size of the pigment should not exceed 0.2 to 0.3 microns.

By the use of the above described dispenser, the water base paint is discharged without foaming, such foaming being a serious objection when dispensing a latex paint with a propellant that is dissolved in or mixed with the paint, the foaming action preventing a uniform rate of flow.

The can above described can be one sold as "Sepro" can (Continental Can Company). With its use, a smaller amount of propellant is required than with the more commonly employed aerosol dispensers wherein the propellant is mixed with the product to be dispensed. The pressurized can above described is operative in any position and the product is maintained separate from the propellant and is kept out of contact with the metal of the can. Approximately 94 – 97% of the contents of the collapsible piston are dispensed. As is known, the propellant is injected through an access opening at the bottom of the can, which is then closed with a special valve or grommet.

The pigment content should be kept relatively low, namely, about 2 to 15%. This provides an additional safety factor, in that evaporation of residual paint can be tolerated to a certain extent without causing gelling or breaking of the paint emulsion.

As will readily be understood, the selected viscosity within the range above disclosed will be related to the nozzle orifice diameter in such manner that a steady and uniform flow of stream of paint will be obtained on opening of the valve. The optimum viscosity for a given nozzle orifice diameter, and likewise the optimum orifice diameter for a given viscosity can be determined by simple experiment.

Although I have shown the grooves or channels 38 as straight, they may also be curved in order to increase the whirling and break-up action on the stream of paint before it enters the passage 36.

I claim:

1. A pressurized dispenser for aqueous latex paint wherein the binder is an acrylic polymer or a vinyl acetate-lower alkyl acrylic ester copolymer, comprising a container having therein a collapsible piston adapted to contain a latex paint with a propellant under pressure in the space between the piston and the wall of the container, a valve controlling the discharge of paint from within the piston, a nozzle into which the paint is conducted for discharge in the form of a spray or mist, and a cap for closing the nozzle orifice and providing at most a free evaporation space about the nozzle orifice which is less in volume than is required for the evaporation, to a substantially solid residue, of any paint clinging to the wall of the nozzle orifice at the termination of a fractional discharge of the contents of the container.

2. A pressurized dispenser as defined in claim 1, wherein the cap is so constructed that it substantially eliminates any free space about the nozzle orifice when said cap is in place upon the nozzle.

3. A pressurized dispenser according to claim 2, wherein the cap includes a conical projection adapted to fit into the nozzle orifice, whereby evaporation of residual paint about the orifice and consequent clogging of the orifice are prevented.

4. A pressurized dispenser according to claim 1, including means in advance of the nozzle for mechanically breaking up the stream of paint discharging upon opening of the valve of the dispenser.

5. A pressurized dispenser according to claim 1, wherein the nozzle orifice has a diameter of 0.016 inch to 0.020 inch.

6. A pressurized dispenser according to claim 4, wherein the nozzle orifice is contained in a nozzle head, the mechanical breaker being formed in the end wall of a counterbore in the rearward portion of the nozzle head, said end wall having a passageway terminating in the orifice, and having a plurality of grooves communicating with said passageway and facing rearwardly of the nozzle head, said passageway receiving the discharging paint upon opening of the valve.

7. A packaged aqueous acrylic emulsion paint comprising a pressurized dispenser, including a container, a discharge nozzle, the container having therein a collapsible piston containing a quantity of said paint, a propellant under pressure in the space between the piston and the wall of the container, a valve controlling the discharge of paint from within the piston, and a nozzle into which the paint is conducted for discharge in the form of a spray, said emulsion comprising an aqueous suspension consisting, in addition to water, essentially of a member of the group consisting of a polymer of a lower alkyl ester of acrylic acid or methacrylic acid, the alkyl group containing up to 4 carbon atoms, or of a copolymer of such lower alkyl ester with polyvinyl acetate, together with a pigment in an amount corresponding to 2 to 15% by weight of the paint, and an antifoam agent, said dispenser, upon opening of the valve, discharging the paint in a form substantially free from foam due in part to the absence of propellant in the paint.

8. A packaged emulsion paint as defined in claim 7, wherein the paint contains, as the pigment, micronized synthetic iron oxide and attapulgus clay.

9. A packaged emulsion paint as defined in claim 7, wherein the paint includes a quantity of attapulgus clay of the order of 27% by weight of the pigment.

10. A package as defined in claim 7, wherein the paint comprises a vinyl-acrylic emulsion and contains a pigment composed of approximately 70–75% of synthetic iron oxide and 30–25% of Attapulgus clay with a vehicle including a wetting agent and an antifoam agent, the viscosity of the paint being approximately in the range of 15 to 60 sec., as measured by the No. 4 Ford cup.

11. A dispenser as defined in claim 7, wherein said pigment is comprised of 70–75% of synthetic iron oxide and 30–25% of Attapulgus clay, and wherein said vehicle is comprised of an emulsion of predominantly water and a vinyl acrylic resin, and including a wetting agent, and an anti-foam agent, the viscosity of the paint composition being approximately in the range of 15 to 60 seconds as measured by a No. 4 Ford cup.

12. A packaged aqueous latex pain comprising a pressurized dispenser of the piston type as defined in claim 1, and containing within the piston an aqueous latex paint comprising a vinyl acetate methyl acrylate copolymer in the proportion of 80:20, approximately 2–15% of a pigment suspended in approximately 98–85% of a vehicle comprising predominantly water and said copolymer, the copolymer constituting approximately 35% of the vehicle, said paint containing also small proportions of a surfactant and an anti-foam agent, and having a viscosity in the range of 10 to 60 sec., as measured on the No. 4 Ford cup, said paint being discharged by the nozzle in the form of a spray from the collapsing piston on opening of the valve and substantially without foaming and thereby yielding a substantially uniform coating owing to the absence of the propellant in the paint.

* * * * *